United States Patent [19]

Muntschick

[11] 4,093,060

[45] June 6, 1978

[54] TYPEWRITER RIBBON FEED DEVICE

[75] Inventor: Peter Muntschick, Dresden, Germany

[73] Assignee: VEB Kombinat Zentronik, Dresden, Germany

[21] Appl. No.: 746,787

[22] Filed: Dec. 2, 1976

[30] Foreign Application Priority Data

Dec. 4, 1975 Germany ..... 189879

[51] Int. Cl.[2] ..... B41J 33/14

[52] U.S. Cl. ..... 400/236.1

[58] Field of Search ..... 197/151, 153 R, 160, 197/162, 163, 164, 165; 101/336

[56] References Cited

U.S. PATENT DOCUMENTS

| | | | |
|---|---|---|---|
| 1,121,038 | 12/1914 | Petermann | 197/151 |
| 1,214,891 | 2/1917 | Briggs | 197/151 |
| 1,215,105 | 2/1917 | Briggs | 197/151 |
| 2,906,203 | 9/1959 | Grosse | 197/162 X |

*Primary Examiner*—Ernest T. Wright, Jr.
*Attorney, Agent, or Firm*—William Anthony Drucker

[57] ABSTRACT

A typewriter ribbon feed device having a transport lever provided at one end with a transport pawl and at the other end with a fork guide engaged by a pin fixed to a driving lever while at one end of the driving lever a suspension hole for a traction bar and a restoring spring is provided, the bearing points of a transport lever, a transport wheel axis and a driving lever being positioned on a straight line.

3 Claims, 4 Drawing Figures

TYPEWRITER RIBBON FEED DEVICE

BACKGROUND OF THE INVENTION

1. Field of the Invention

This invention relates to a control for an ink ribbon feed device for office machines, particularly typewriters, with a ribbon spool, a transport wheel and a connecting element to transmit the transport drive from the universal bar to a ribbon feed device.

2. Description of the Prior Art

Ribbon feed devices are known which are provided with a transport lever having a transport pawl, the lever being situated in the center of the spool or at a distance therefrom and the pawl being held by a torsion or traction spring in the teeth of the transport wheel, and with a connecting element to the universal bar, with a restoring spring.

A drawback of this system is that a connecting element from the universal bar is attached to the actual transport wheel, so that this latter can easily jam or tilt over. For this reason, use is made of complicated bearing points, expensive to produce, with bushings and a long rivet, or else of U-shaped and double-U-shaped supporting devices manufactured at great expense. The force taken off by the transport lever is only variable if the disadvantages of the transmission characteristics of this system are accepted. This is the reason why the transport levers are comparatively long and extend from the assembly, precluding a compact construction. It is thus hardly possible for ribbon feed devices of this kind to be adapted to adjacent units of machinery as and when these are developed further. The force and speed characteristics for the longitudinal movement of the ribbon remain constant, having an unfavourable effect on the operator's "touch", as the transport lever is directly articulated to the universal bar via a connecting element.

SUMMARY OF THE INVENTION

An object of the invention is to improve the operational reliability of the ribbon transport system and also to reduce the cost of its manufacture, assembly and adjustment.

An object of the invention is to provide a control system for a ribbon feed device, ensuring reliable transport regardless of the diameter of the transport wheel and the rotary movement of the universal bar and its spatial position in relation to the fulcrum of the said wheel, aiming at a compact construction and making use of flat components with only a small number of bends or offset parts and also of simple bearing points.

The invention enables this object to be achieved as a result of the fact that the transport lever, of a type usual in itself, consists of two levers, a driving lever and a transport lever with a transport pawl, these being operatively interconnected.

The suspension hole in the driving lever is engaged by a traction bar, which provides the connection to the universal bar, and a restoring spring, which is at the same time articulated to the supporting part.

The driving lever is also fitted with a special pin providing an operative interconnection to the fork guide at the end of the transport lever.

The bearing points of the transport lever, of the transport wheel axis and the driving lever and of the driving lever are positioned along a theoretical connecting line. The connection between the special pin and the fork guide can be pivoted evenly in both directions about the connecting line.

The special pin has a shaped piece with a convex surface serving as a support and spacer in relation to the supporting part.

The speed of the ribbon feed increases as the keys descend, reaching its maximum when the connecting line coincides with the connection of fork guide and special pin and then once again decreases.

To enable the driving forces for the ribbon transport to be kept to the minimum, the traction bar suspension holes on the universal bar and on the driving lever and also those for the restoring spring on the suspension hole and on the suspension lug of the support are situated along a line.

DESCRIPTION OF THE PREFERRED EMBODIMENT

Figure 1:
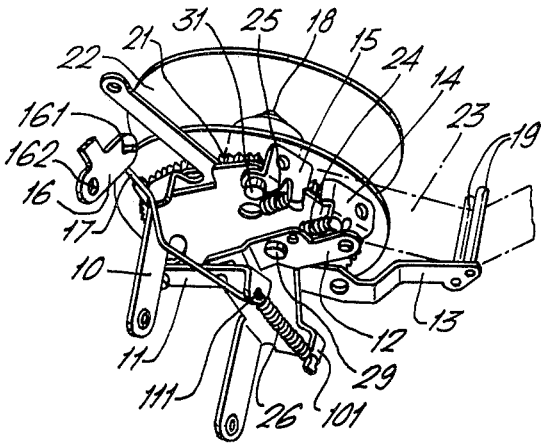
FIG. 1 is a view, in perspective, of the control system for the ink ribbon feed device, in its position of rest.
Figure 2:
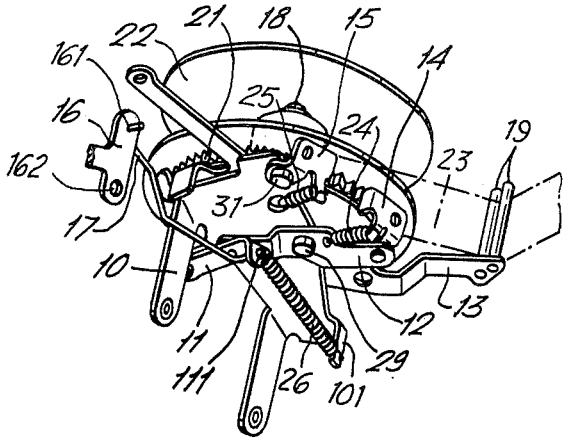
FIG. 2 is a view, in perspective, of the control system for the ribbon feed device, pivoted into its operating position.
Figure 3:
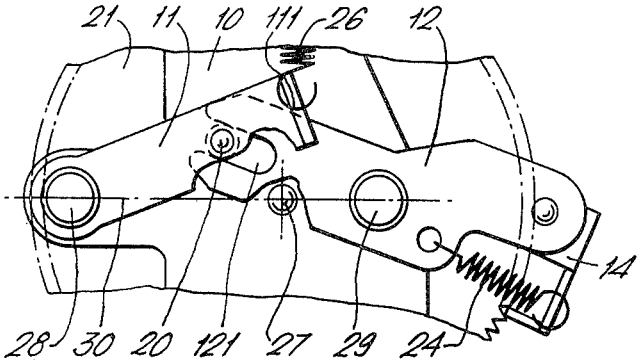
FIG. 3 is a view of the ribbon feed device.

On a support 10 affixed to the side wall of the machine are mounted the transport wheel axis or first axis 18 with a toothed transport wheel 21 in the bearing point 27 and the shift lever 13 with the guide bolts 19 (FIGS. 1 and 2). Underneath the support 10 a transport lever 12 is mounted by way of a bearing 29, the lever 12 being able to pivot about the bearing 29 which thereby constitutes a second axis. Also underneath the support 10 a driving lever 11 carrying a pin 20 is pivotally mounted for pivotal movement about a third axis defined by a bearing point 28, spaced from the first and second axes 18, 29. The transport lever 12 carries at one end a rotatably mounted transport pawl 14, urged into engagement with the teeth of the transport wheel 21 by means of a spring 24 (FIG. 3).

Figure 4:
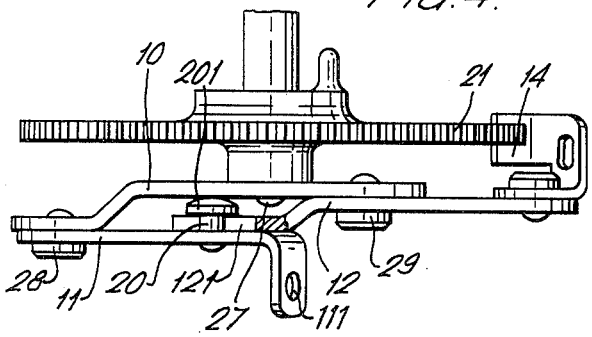
FIG. 4 is a view of the connecting point between the special pin and the fork guide.

The special pin 20 is provided with a shaped piece consisting of a convex surface 201 to provide a support and spacer in relation to the support 10 (FIG. 4). A traction spring 24 is flexibly attached between the transport lever 12 and the transport pawl 14.

The driving lever 11 is provided with a suspension hole 111, engaged by a traction bar 17 and a restoring spring 26. The other end of the restoring spring 26 is affixed to the suspension lug 101 of the support 10.

The universal bar 16, which performs an even pivoting movement about the bearing point 162 each time a type bar is struck, is coupled to the driving lever 11 via a traction bar 17 which engages the suspension hole 161 of the universal bar 16. This movement is transmitted to the transport lever 12 by means of the special pin 20 and the fork guide 121, in such a way that the driving lever 11 and the transport lever 12 pivot evenly over the middle of the connecting line 30.

The connecting line 30 is a theoretical line between the bearing points 27, 28 and 29 of the transport wheel axle 18, the driving lever 11 and the transport lever 12.

Owing to the pivoting movement of the universal bar 16 and the connection between the pin 20 and the fork guide 121, the transport pawl 14 affixed to one end of the transport lever 12 has speed characteristics which are such that at the beginning of the descent of the key the speed slowly increases, reaching its maximum as the connecting line 30 is passed, after which the speed decreases to zero.

The transport pawl 14 engages the teeth of the transport wheel 21 and moves the ribbon 23 wound onto the ribbon spool 22 each time a type bar is struck.

A pawl 15, mounted by way of a pivot point 31 on the support 10 and urged by a spring 25 into engagement with the teeth of the transport wheel 21, prevents the transport wheel 21 from moving back again.

The reversal of the ribbon feed movement is affected in the known manner by the traction of the ribbon 23, exerted on the guide bolts 19 and the shift lever 13.

I claim:

1. An ink ribbon feed device for a typewriter comprising:

a support, a toothed transport wheel mounted for rotation on said support about a first axis;

a ribbon spool carried by said support;

a transport lever pivotally mounted on said support for pivotal movement about a second axis;

a transport pawl rotatably carried by said transport lever;

a spring mounted between said transport pawl and said transport lever to urge said transport pawl into engagement with the toothed transport wheel;

a forked end on said transport lever remote from said transport pawl;

a driving lever pivotally mounted on said support for pivotal movement about a third axis, said first, second and third axes being positioned substantially along a straight connecting line;

a pin carried by said driving lever;

means for operatively interconnecting said driving lever and said transport lever whereby pivotal movement of said driving lever causes pivotal movement of said transport lever, said means being constituted by the engagement of said pin in said forked end of said transport lever;

a traction bar connected to said driving lever;

a universal bar of the typewriter connected to said traction bar; and a restoring spring mounted between said driving lever and said support, wherein said pin includes an enlarged head portion which rests against said support.

2. An ink ribbon feed device according to claim 1, wherein said enlarged head portion of said pin is convex shaped.

3. An ink ribbon feed device according to claim 1, the points of connection of said traction bar with said driving lever and said universal bar lying on a substantially straight line with the points of connection of said restoring spring with said driving lever and said support.

* * * * *